United States Patent [19]

Kowalski

[11] 4,340,388

[45] Jul. 20, 1982

[54] DYEING OF TEXTILE MATERIALS

[75] Inventor: Xavier Kowalski, St. Louis, Mo.

[73] Assignee: Monsanto Company, St. Louis, Mo.

[21] Appl. No.: 282,313

[22] Filed: Jul. 10, 1981

Related U.S. Application Data

[63] Continuation-in-part of Ser. No. 135,424, Mar. 31, 1980, abandoned, which is a continuation-in-part of Ser. No. 67,575, Aug. 17, 1979, abandoned.

[51] Int. Cl.[3] ..... D06P 1/667

[52] U.S. Cl. ..... 8/584; 8/492; 8/922

[58] Field of Search ..... 8/584, 492

[56] References Cited

U.S. PATENT DOCUMENTS

| | | | |
|---|---|---|---|
| 3,052,653 | 9/1962 | Iannicelli | 8/584 |
| 3,303,139 | 2/1967 | Blaser et al. | 8/584 |
| 3,765,831 | 10/1973 | Senez | 8/584 |
| 4,113,429 | 9/1978 | Kruse et al. | 8/584 |

FOREIGN PATENT DOCUMENTS

| | | | |
|---|---|---|---|
| 2249218 | 4/1974 | Fed. Rep. of Germany | 8/584 |
| 50-53674 | 5/1975 | Japan | 8/584 |

OTHER PUBLICATIONS

Chem. Abstracts vol. 88: 106714t (1978).

*Primary Examiner*—Maria Parrish Tungol
*Attorney, Agent, or Firm*—G. R. Beck; W. H. Duffey; S. M. Tarter

[57] ABSTRACT

Including an aminophosphonate and a hydroxyphosphonate in an aqueous bath in which a textile material is dyed with a water-insoluble (e.g. disperse) dye results in improved dyeing (uniformity, water-fastness, etc.) and, in dyeing of polyester fiber, eliminates the need for use of a swelling agent.

13 Claims, No Drawings

DYEING OF TEXTILE MATERIALS

CROSS-REFERENCE TO RELATED APPLICATIONS

This is a continuation-in-part of application Ser. No. 135,424 filed Mar. 31, 1980, now abandoned, as a continuation-in-part of application Ser. No. 67,575 filed Aug. 17, 1979, now abandoned.

BACKGROUND OF THE INVENTION

Dyeing of textile materials in an aqueous bath with water-insoluble dyes, e.g. disperse, vat, naphthol, sulfur and pigment dyes, is widely practiced. However, the tendency of such dyes to agglomerate interferes with their penetration of textile fiber surfaces, causing problems in dyeing characteristics, e.g. dyeing uniformity and waterfastness. Improvements in such dyeing characteristics are of constant interest and importance in the textile industry. In dyeing of polyester fiber, swelling agents are commonly used to expand the fibers for better dye penetration, but environmental objections have been raised concerning certain of such swelling agents. Diminishment or elimination of their use may become advisable, and an alternate technique for improving the dyeability of polyester fiber is therefore gaining in commercial significance.

Accordingly, it is an object of this invention to provide a process for dyeing of textile materials with water-insoluble dyes in an aqueous bath whereby improved dyeing characteristics, and particularly improved dyeing uniformity and/or waterfastness, are achieved. Another object is to provide such a process which eliminates or at least diminishes the need for use of polyester fiber swelling agents. Another object is a method for the preparation of dye compositions which provide such advantages. Still another object is textile materials having superior dye uniformity as a result of such improved dyeing. These and other objects of the invention will be more fully apparent from the following disclosure in which all percentages and parts are by weight except where otherwise noted, and all temperatures are in degrees Centigrade.

SUMMARY OF THE INVENTION

In accordance with this invention, textile materials are dyed with a water-insoluble dye in an aqueous bath in accordance with a process improved by including in the bath (a) one or more aminophosphates, e.g. from the group consisting of aminotri(methylene phosphonic acid) and alkali metal salts thereof and (b) one or more hydroxyphosphonates, e.g. from the group consisting of 1-hydroxyethane-1,1-diphosphonic acid and alkali metal salts thereof. Also provided by the invention are water-insoluble dye compositions comprising (a) and (b), which compositions are useful in improved dyeing of textile materials, and a method for preparing such dye compositions by combining (a) and (b) with a water-insoluble dye. Also provided are textile materials which have been dyed with use of the improved process and/or compositions of this invention.

PRIOR ART

Japanese Patent Publication No. 50-53674 (May 12, 1975) by Rin Kagaku Kogyo K. K. discloses dyeing of polyester and other fabrics in an aqueous bath containing a disperse dye and tris(phosphonomethyl)amine. West German Offen. No. 2,816,539 (Oct. 26, 1978) discloses dyeing of textiles using aqueous dye preparations containing a water-insoluble dye and a complexing agent, such as (among various others) aminotri(methylenephosphonic acid) or 1-hydroxyethane-1,1-diphosphonic acid to improve redispersability. According to 88 Chem. Abstracts 106714t (1978), West German Offen. No. 2,732,216 (Jan. 26, 1978) discloses addition of 1-hydroxyethanediphosphonic acid or [nitrilotris(methylene)]tris(phosphonic acid) to dyeing compositions containing disperse dyes having metal ion impurities to improve dye lightfastness and diminish shade changes.

DETAILED DESCRIPTION OF THE INVENTION

This invention is useful in dyeing of any textile materials which can be dyed with water-insoluble dyes. Such textile materials include most commonly synthetic fibers such as, e.g. polyesters, polyamides and polyacetates. Typically disperse dyes are used in dyeing of polyesters, e.g. polyethylene terephthalate, and the invention is especially applicable thereto. While such dyeing can be carried out while the textile material is in the form of fiber, e.g. continuous filament or spun staple, it is also commonly carried out on knitted, woven or "nonwoven" fabric made with such fiber.

As used herein, the term "water-insoluble dye" refers to a dye having a solubility of less than 0.05 grams per liter of water at temperatures below 155°. Such dyes include primarily disperse dyes but also vat dyes, naphthol dyes, sulfur dyes and pigment dyes from a wide variety of chemical classes. The disperse dyes include, e.g. nitro, aminoketone, ketonamine, methine, polymethine, diphenylamine, quinoline, benzimidazole, xanthene, thioxanthene, oxazine, aminonaphthoquinone, coumarin, quinophthalone, styryl, azostyryl, naphthoperinone and naphthoquinonimine dyes which do not contain water-solubilizing (polar) groups in the molecule and, generally most importantly for dyeing of polyester, those selected from the group consisting of anthroquinone and azo dyes. Various vat, sulfur and pigment dyes are also well known. Usually such dyes are made and distributed in compositions (usually but not necessarily aqueous) containing from about 5% to about 50% of the water-insoluble dye. Mixtures of such water-insoluble dyes are commonly used, and it is also known to include water-soluble dyes in such compositions, e.g. for dyeing of fiber blends such as cotton/-polyester.

Preferred among the aminophosphonates useful in this invention are aminotri(methylene phosphonic acid) and its full and partial alkali metal (particularly sodium) salts. The hydroxyphosphonates preferred for use in this invention are 1-hydroxyethane-1,1-diphosphonic acid and its full and partial alkali metal (particularly sodium) salts. More than one aminophosphonate or hydroxyphosphonate may also be used. Homologs and other structurally obvious variations of such phosphonates will probably provide substantially equivalent results in many cases.

In general, best results are obtained when the phosphonates are used in a mole ratio of hydroxyphosphonate:aminophosphonate between about 0.5:1 and about 5:1, although lower or higher ratios may be satisfactory in some instances. In preferred embodiments of the invention, the mole ratio of hydroxyphosphonate:aminophosphonate is usually between about 0.6:1 and about 4:1, and even more commonly between about 0.7:1 and about 3:1. Normally, e.g. when the phosphonates are used in an aqueous bath containing from about 0.5 to about 3% water-insoluble dye, best results are achieved using the phosphonates in a combined amount between about 0.5 and about 10 millimoles per kilogram of textile material to be dyed and/or between about 0.005% and about 0.1% (preferably between about 0.01% and about 0.075%) of the aqueous dye bath. Good results are also normally obtained using a weight ratio of the phosphonates to water-insolube dye from about 0.01 to about 1 (preferably from about 0.05 to about 0.5). However, other weight ratios of the phosphonates to textile material, dye and/or dye bath may be suitable in some instances.

Although the invention is not to be limited in accordance with a theory of its mechanism, it is possible that the phosphonates assist in dispersion of water-insoluble dyes by inhibiting their tendency to agglomerate. This may explain the ability of the phosphonates to bring about more uniform and/or water-fast dyeing, even in the dyeing of polyester fibers in the absence of swelling agents which normally expand the polyester fibers to admit larger particles of the dye.

Inclusion of such phosphonates in the dye-containing compositions employed in this invention can be accomplished by various conventional procedures, e.g. stirring or blending a mixture of the dye and phosphonates, normally for about 10 to 30 minutes and usually most conveniently at room temperature. Although this can be done anhydrously, it is generally more convenient to introduce the phosphonates in the form of their aqueous solutions containing, e.g. from about 10% to about 70% (preferably from about 20% to about 60%) phosphonate. In other embodiments, the dye and phosphonates are added separately to the aqueous bath in which the textile material is dyed. This can be accomplished by various standard techniques for mixing of the bath constituents, and may be done prior to heating of the bath to elevated dyeing temperatures or, in continuous systems, by addition to a bath maintained at the desired dyeing temperature. Whether combining the phosphonates with the dye in an aqueous dye bath or before the dye is put in such a bath, essentially uniform dispersion of the phosphonates in the bath or dye is normally preferred.

Other constituents may be present in the dye composition and/or bath to the extent they do not prevent substantial realization of objects of this invention. Such additional constituents commonly include dispersing agents, wetting agents and/or grinding auxiliaries. Examples and typical concentrations of such compositions are described in U.S. Pat. No. 4,113,429, the disclosure of which is incorporated herein by reference.

The textile material dyeing processes which are improved in accordance with this invention are well known in the art, e.g. U.S. Pat. No. 4,113,429. Although this invention can be used to improve the uniformity and/or waterfastness of dyeing carried out below 100°, best results, including particularly the elimination or diminishment of need for a swelling agent for polyester fibers, are obtained when the dyeing is carried out above 100° (preferably from about 110° to about 150°) under superatmospheric pressure sufficient to prevent unacceptable evaporative loss of water from the dye bath.

The following examples are included to illustrate the invention without implying any limitation on its scope. In these examples, the following representative water-insoluble disperse dyes are used:

| Tradename | Structural Formula | Colour Index Name & Number |
|---|---|---|
| Dispersol Blue B2G (hereinafter B2G) - Imperial Chemical Industries | 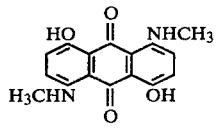 | Disperse Blue 26:1 (63305) |
| Sodyecron Yellow WLS (hereinafter WLS) - SoDye Co. | 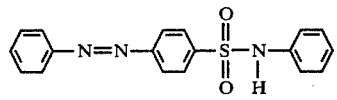 | Disperse Yellow 42 (1038) |
| Eastman PE Yellow 5R (hereinafter 5R) - Eastman Kodak Co. | 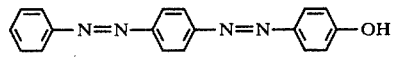 | Disperse Yellow 23 (26070) |
| Dispersol Yellow C5G (hereinafter C5G) - Imperial Chemical Industries | (Unknown) | Disperse Yellow 119 (No Number) |
| Genacron Orange GL (hereinafter GL) - General Aniline & Film or Amacron Orange SF (hereinafter SF) - American Color Co. | (Unknown) | Disperse Orange 29 (No Number) |

EXAMPLES 1-2

Identical samples of texturized continuous filament polyester (polyethylene terephthalate) yarn are dyed with the aforedescribed water-insoluble disperse dyes in a package dye machine. The yarn samples are immersed in 38° C. water prewet with 0.02% (based on weight of fiber; hereinafter "OWF") of a conventional wetting agent. The bath temperature is raised to 52° and the dye is added in a concentration of 1% OWF. Dyes C5G and B2G in grain form are added to their respective baths without pasting. The other dyes are added after being pasted with a conventional wetting agent in cold water and then diluted with 82° water. The bath (10:1 weight ratio of bath to fiber) is circulated for 15 minutes, then heated to 82° at 2.2°/minute, circulated an additional 30 minutes, then heated to 91° C. at 0.55°/minute, circulated an additional 15 minutes, then heated to 129°, maintained at that temperature for 45 minutes and then cooled to 77°. The bath is then drained and replaced with hot water. The yarn is subjected to a running rinse until the rinse water is clear. Thereafter the dyed yarn is scoured with 93° water containing (OWF) 1% $NaHCO_3$ and 0.25% conventional nonionic surfactant.

In Example 1, there is included in the bath and maintained uniformly dispersed therein during dyeing 0.19% OWF (0.019% of the bath) of a mixture of aminotri(methylene phosphonic acid) (hereinafter ATMP) and 1-hydroxyethane-1,1-diphosphonic acid (hereinafter HEDP) in a mole ratio of HEDP:ATMP of 2:1. In Example 2, there is similarly used 0.13% OWF of an equimolar mixture of ATMP and HEDP. In comparative Example A, there is similarly used 0.16% OWF of HEDP alone. In these examples, the phosphonates are used in the following concentrations in millimoles per kilogram of fiber: Example 1—7.9; Example 2—5.2; Example A—7.9.

After the dyeing and scouring, the yarn samples are knitted into tubes which are compared for color depth using a conventional General Electric Co. recording spectrophotometer. The scans are interpreted using the wave lengths of maximum absorptions and maximum reflectances. The resulting data indicative of color yield are in Table I. The indicated percents reflectance are those of greatest absorption indicating greatest depth of color. In addition, the differences (deviations) in color yield are determined using outside, center and inside portions of the fabrics. These data are also in Table I. In evaluation of this data, ratings are assigned to the performance (color depth and uniformity) for each dyed sample at minimum and maximum reflectances. The ratings range from best (5) through worst (1) for each of the phosphonate mixtures and phosphonate used in Examples 1, 2 and A, and for several phosphonates structurally different from HEDP and ATMP. These values are then separately summed and averaged to arrive at the relative ratings ($\overline{X}$) of performance in color depth (c) and dye uniformity (d) set forth in Table I.

TABLE I

| | | Example 1 | | Example 2 | | Example A | |
|---|---|---|---|---|---|---|---|
| Dye | λ | c | d | c | d | c | d |
| C5G | 450[a] | 3.0 | 0.3 | 3.0 | 0.6 | 3.0 | 0.3 |
| | 580[b] | 83.5 | 1.0 | 82.2 | 0.3 | 82.3 | 0.4 |
| 5R | 410[a] | 3.5 | 0.5 | 3.4 | 0.2 | 3.7 | 0.5 |
| | 620[b] | 82.0 | 3.7 | 75.5 | 4.2 | 76.0 | 13.5 |
| SF | 460[a] | 4.5 | 0.2 | 4.5 | 0.2 | 5.2 | 0.2 |
| | 460[b] | 85.0 | 8.5 | 85.5 | 9.5 | 89.3 | 14.8 |
| WLS | 420[a] | 12.0 | 0.7 | 12.6 | 0.4 | 13 | 0.5 |

TABLE I-continued

| | | Example 1 | | Example 2 | | Example A | |
|---|---|---|---|---|---|---|---|
| Dye | λ | c | d | c | d | c | d |
| | 580[b] | 79.4 | 1.9 | 80.5 | 2.0 | 81.5 | 3.5 |
| B2G | 410[a] | 31.8 | 0.5 | 30.8 | 2.1 | 29.5 | 1.8 |
| | 630[b] | 5.0 | 0.1 | 4.9 | 0.3 | 4.8 | 0.6 |
| Total Lowest % R* | | 21 | 20 | 22 | 19 | 17 | 18 |
| Total Highest % R | | 17 | 21 | 13 | 20 | 17 | 10 |
| $\overline{X}$ Lowest % R | | 4.2 | 4.0 | 4.4 | 3.8 | 3.4 | 3.6 |
| $\overline{X}$ Highest % R | | 3.4 | 4.2 | 2.6 | 4.0 | 3.4 | 2.0 |
| $\overline{X}$ | | 3.8 | 4.1 | 3.5 | 3.9 | 3.4 | 2.8 |

[a] = Wavelength of minimum reflectance, millimicrons
[b] = Wavelength of maximum reflectance, millimicrons
[c] = % Reflectance
[d] = Deviation as % Reflectance
*R = Reflectance In a second set of dyeing depth and uniformity determinations in which 0.11% OWF of HEDP (Comparative Example C) is compared with 0.16% OWF of ATMP (Comparative Example D) and a polycarboxylate under test conditions otherwise identical to those in Examples 1, 2 and A, the values in Table II are obtained. Since the ratings (from 5 through 1) assigned to the data in Table II are relative to those for the polycarboxylate rather than the structurally dissimilar phosphonates with which the phosphonate mixtures and phosphonate were directly compared in Examples 1, 2 and A, the $\overline{X}$ and $\overline{X}$ values in Table II are not directly comparable with those in Table I.

More specifically, the $\overline{X}$ and $\overline{X}$ values for HEDP in Example A differ from those for HEDP in Example C because the ratings of HEDP in Table II are relative to ATMP (Example D) and the aforementioned polycarboxylate, while the ratings of HEDP in Table I are relative to HEDP/ATMP mixtures (Examples 1-2) and the aforementioned structurally dissimilar phosphonates. However, the differences among the phosphonate concentrations used in the examples in Tables I and II had no significant effect on the relative performance ratings in those tables. Accordingly, the ratings of HEDP relative to the other compounds used in the examples in Tables I and II provide a valid (although indirect) basis for comparing the performance of ATMP (Example D) with that of the HEDP/ATMP mixtures used in Examples 1-2.

TABLE II

| | | Example C | | Example D | |
|---|---|---|---|---|---|
| Dye | λ | c | d | c | d |
| WLS | 420[a] | 13 | 0.5 | 12 | 0.5 |
| | 580[b] | 78 | 2.0 | 70 | 8.5 |
| 5R | 410[a] | 3 | 0 | 3 | 0 |
| | 620[b] | 56 | 20 | 61 | 9.5 |
| GL | 460[a] | 3 | 0 | 3.5 | 0 |
| | 660[b] | 68 | 3 | 66.5 | 6 |
| GL | 460[a] | 0.5 | 0.5 | 2.5 | 0 |
| (2%) | 660[b] | 60 | 6 | 56 | 8 |
| C5G | 450[a] | 3.5 | 0 | 3.5 | 0 |
| | 580[b] | 80 | 2 | 78 | 3 |
| B2G | 410[a] | 32 | 2 | 34.5 | 7 |
| | 630[b] | 6 | 1 | 6 | 2 |
| Total Lowest % R | | 22 | 23 | 21 | 22 |
| Total Highest % R | | 16 | 20 | 21 | 16 |
| $\overline{X}$ Lowest % R | | 4.4 | 4.6 | 4.2 | 4.4 |
| $\overline{X}$ Highest % R | | 3.2 | 4.0 | 4.2 | 3.2 |
| $\overline{X}$ | | 3.8 | 4.3 | 4.2 | 3.8 |

[a, b, c, d] R = same as in Table I.

From the data in Tables I and II, it can be seen that the dyeing uniformity achieved in Examples 1 and 2 is substantially greater than that obtained with HEDP alone (Example A) and that the dyeing uniformity achieved with HEDP alone in Example C is substantially greater than that achieved in Example D with ATMP alone. Accordingly, use of the combination of phosphonates is found to be substantially superior to the use of either the aminophosphonate or hydroxyphosphonate alone.

EXAMPLE 3

In comparative tests using AATCC Test Method 61-1975 II-A (modified by eliminating sodium metasilicate) and 13 different kinds of natural and synthetic fibers, it is found that, on average, the fibers dyed in accordance with the procedure in Examples 1 and 2 have greater dye waterfastness than those dyed in accordance with Comparative Example A and, in turn, those dyed in accordance with Example C have greater dye waterfastness than those dyed in accordance with Example D, indicating again the superiority of use of the combination of aminophosphonate and hydroxyphosphonate.

EXAMPLE 4

Other comparative tests of polyester knit and package dyeing are carried out using several mixtures of conventional disperse dyes in baths containing 1% acetic acid and 2–3.1% dye (132° maximum temperature). In these tests in which, by weight of the dye bath, 3% of a commonly used phenolic-type swelling agent and 0.5% of a standard tetracarboxylic suquestrant are replaced with 1.05% of a mixture of ATMP and HEDP (bath pH of 4.5) in which the mole ratio of HEDP:ATMP is 1.74:1, it is found that color yield, uniformity and fastness to light, washing, perspiration and wet and dry crocking achieved with use of the combination of phosphonates are comparable to those obtained using the swelling agent and tetracarboxylic sequestrant.

I claim:

1. In a process for dyeing textile material with a water-insoluble dye in an aqueous bath, the improvement which comprises including in said bath (a) aminophosphonate selected from the group consisting of aminotri(methylene phosphonic acid) and alkali metal salts thereof and (b) hydroxyphosphonate selected from the group consisting of 1-hydroxyethane-1,1-diphosphonic acid and alkali metal salts thereof in a combined amount sufficient to increase the uniformity of said dyeing and in a mole ratio of (b):(a) sufficient to increase said uniformity above that obtained with the same amount of (a) alone.

2. The process improvement of claim 1 wherein said ratio is between about 0.5:1 and about 5:1.

3. The process improvement of claim 1 wherein the textile material comprises polyester, the dye comprises disperse dye and the dyeing is carried out above 100° C.

4. The process improvement of claim 3 wherein said ratio is between about 0.6:1 and about 4:1.

5. The process improvement of claim 3 wherein said dye is selected from the group consisting of azo and anthroquinone dyes.

6. A composition comprising a water-insoluble dye suitable for dyeing of textile material in an aqueous bath, (a) aminophosphonate selected from the group consisting of aminotri(methylene phosphonic acid) and alkali metal salts thereof and (b) hydroxyphosphonate selected from the group consisting of 1-hydroxyethane-1,1-diphosphonic acid and alkali metal salts thereof, the mole ratio of (b):(a) being between about 0.5:1 and about 5:1.

7. A composition of claim 6 wherein (a) and (b) are present in a combined amount between about 5% and about 50% by weight of said dye.

8. A composition of claim 6 wherein said dye is selected from the group consisting of azo and anthroquinone dyes.

9. A composition of claim 6 wherein said dye comprises a disperse dye suitable for dyeing polyester fiber.

10. A composition of claim 9 wherein said ratio is between about 0.7:1 and about 3:1.

11. A method for preparing a water-insoluble dye composition suitable for use in dyeing of textile material in an aqueous bath, which method comprises combining with said dye (a) aminophosphonate selected from the group consisting of aminotri(methylene phosphonic acid) and alkali metal salts thereof and (b) hydroxyphosphonate selected from the group consisting of 1-hydroxyethane-1,1-diphosphonic acid and alkali metal salts thereof in a mole ratio of (b):(a) between about 0.5:1 and about 5:1.

12. The method of claim 11 wherein (a) and (b) are combined with said dye in amounts totaling between about 5% and about 50% by weight of said dye.

13. The method of claim 11 wherein said dye comprises a disperse dye suitable for dyeing polyester fiber.

* * * * *

UNITED STATES PATENT AND TRADEMARK OFFICE

CERTIFICATE OF CORRECTION

PATENT NO. : 4,340,388

DATED : July 20, 1982

INVENTOR(S) : Xavier Kowalski

It is certified that error appears in the above—identified patent and that said Letters Patent is hereby corrected as shown below:

Column 1, line 49, change "aminophosphates" to --aminophosphonates--.

Column 3, line 11, from "water-insolube" to --water-insoluble--.

Column 4, line 11 diagram, change from "(1038)" to --(10338)--.

Column 5, line 57, from "($\bar{X}$)" to --($\bar{\bar{X}}$)--.

Column 6, line 31, from ($\bar{X}$)"(second occurrence) to --($\bar{\bar{X}}$)--.

Column 7, line 31, from "suquestrant" to --sequestrant--.

Signed and Sealed this

*Twenty-first* Day of *September 1982*

[SEAL]

*Attest:*

GERALD J. MOSSINGHOFF

*Attesting Officer*

*Commissioner of Patents and Trademarks*